United States Patent [19]

Hart

[11] 3,983,662

[45] Oct. 5, 1976

[54] PUSH TOY FOR PICKING UP THREE-DIMENSIONAL OBJECTS

[75] Inventor: William Hart, Palos Verdes Estates, Calif.

[73] Assignee: Mattel, Inc., Hawthorne, Calif.

[22] Filed: Sept. 24, 1975

[21] Appl. No.: 616,463

[52] U.S. Cl. ..... 46/205

[51] Int. Cl.[2] ..... A63H 17/00

[58] Field of Search ..... 46/40, 202, 204, 205, 46/141; 428/315

[56] References Cited

UNITED STATES PATENTS 2,772,196 11/1956 Pooley ..... 428/315 X 3,170,832 2/1965 Wilson et al. ..... 428/315 X

FOREIGN PATENTS OR APPLICATIONS 1,362,035 4/1964 France ..... 428/315

*Primary Examiner*—F. Barry Shay

*Attorney, Agent, or Firm*—Stephen King; Max E. Shirk; Robert W. Mulcahy

[57] ABSTRACT

Single, soft, polymeric-foam impeller is rotated into engagement with objects to be picked up and flips them up a ramp into a collection container. The impeller is releasably connected to grippers and is reinforced by a tough polymeric sheet sandwiched between two layers of polymeric foam.

2 Claims, 4 Drawing Figures

PUSH TOY FOR PICKING UP THREE-DIMENSIONAL OBJECTS

BACKGROUND OF THE INVENTION

The background of the invention will be set forth in two parts.

1. Field of the Invention

The present invention pertains generally to the field of push toys and more particularly to a new and useful push toy adapted to pick up three-dimensional objects lying on a supporting surface.

2. Description of the Prior Art

The prior art known to applicant is listed by way of illustration, but not of limitation, in separate communications to the United States Patent Office.

The present invention exemplifies improvements over this prior art and over two similar push toys disclosed in copending application Ser. No. 577,967; filed May 15, 1975, now abandoned, and application Ser. No. 578,285 filed May 16, 1975, now U.S. Pat. No. 3,959,922. Both of these applications are assigned to the assignee of the instant application.

SUMMARY OF THE INVENTION

It is an object of the present invention to provide a new and useful push toy adapted to pick up three-dimensional objects lying on a supporting surface.

Another object of the present invention is to provide a toy of the type described including a single, soft spongy impeller which is driven by grippers adapted to release the impeller under adverse operating conditions.

According to the present invention, a push toy is provided for picking up three-dimensional objects lying on a supporting surface. The toy includes a chassis having an object inlet and an object outlet. A pair of wheels are rotatably mounted on the chassis and include ring gears which drive pinions releasably connected to a single, soft, spongy impeller rotated by the wheels when the toy is pushed over the supporting surface. The rotating impeller engages the objects and flips them up a ramp and into a container which may be an open-topped catcher simulating a grass catcher on a lawn mower so that a child-user of the push toy may see the objects being discharged through the object outlet by the impeller. The impeller is preferably made from a soft spongy material, like polymeric foam, which is reinforced by a tough polymeric sheet sandwiched between two layers of polymeric foam.

The impeller is connected to the pinions by grippers exerting sufficient force to hold the impeller under normal operating conditions. However, the grippers will release the impeller under adverse operating conditions.

The features of the present invention which are believed to be novel are set forth with particularity in the appended claims. The present invention, both as to its organization and manner of operation, together with further objects and advantages thereof, may best be understood by reference to the following description taken in connection with the accompanying drawings in which like reference characters refer to like elements in the several views.

DESCRIPTION OF THE PREFERRED EMBODIMENT

Figure 1:
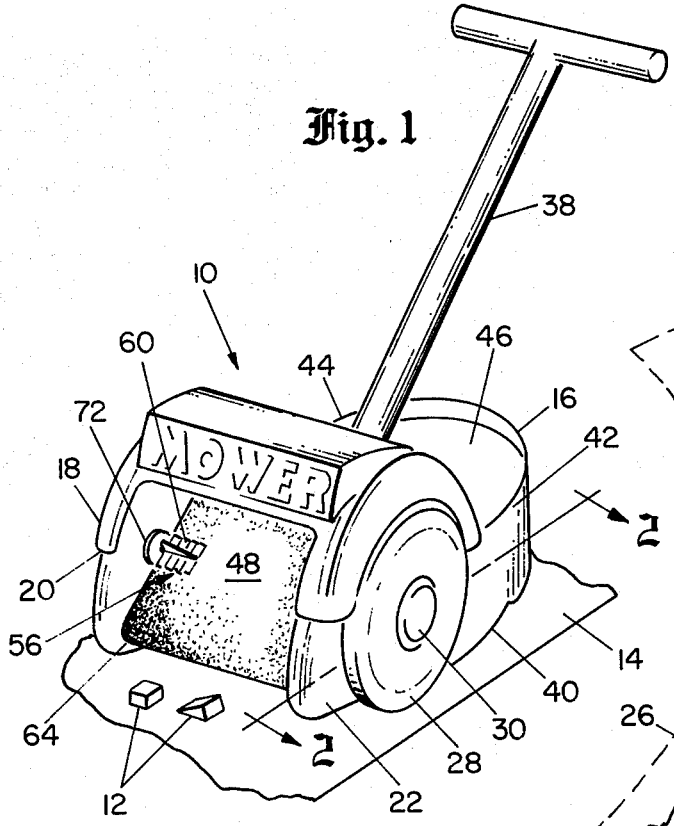
FIG. 1 is a perspective view of a push toy constituting a presently-preferred embodiment of the invention.

Referring again to the drawing, a push toy constituting a presently preferred embodiment of the invention, generally designated 10, is shown herein for purposes of illustration, but not of limitation, as simulating a lawn mower adapted to pick up three-dimensional objects 12 lying on a supporting surface 14 in the path-of-travel of toy 10 and discharge them into a collection container 16 which is preferably an open-topped receptacle simulating a grass catcher on a lawn mower. This gives a child-user an unobstructed view of the objects being discharged into container 16.

Push toy 10 includes a chassis 18 having a pair of plates 20, 22 connected together in spaced relation by a rearwardly, upwardly sloping ramp 23 to define an object inlet 24 and an object outlet 26. A pair of wheels, like the one shown at 28, are rotatably mounted on plates 22, 20, respectively, by suitable axles, like the one shown at 30 for wheel 28. Axle 30 is journalled in a bearing 32 engaged in a hollow boss 34 provided on plate 22 and is keyed to bearing 32 by a pin 36 engaging the hollow, inner surface of axle 30.

Push toy 10 also includes a handle assembly 38 having a handle portion (not shown). Handle assembly 38 is connected to chassis 18 by suitable connectors (not shown). Container 16 includes a comparatively rigid bottom wall 40 and a fairly flexible sidewall 42 upstanding from bottom wall 40 and defining an open front portion 44 and an open top portion 46. Suitable fasteners (not shown) may be used to connect sidewall 42 to chassis 18 with open front portion 44 in communication with object outlet 26.

Push toy 10 also includes an impeller assembly 48 which may be made from two rectangular members 50, 52 having a tough polymeric sheet 54 sandwiched between them. This forms a unitary structure without a center shaft. The members 50, 52 are preferably made from a soft spongy material, like polymeric foam, so that they will conform themselves to the shape of objects 12. Sheet 54 reinforces members 50, 52 to resist tearing.

Figure 3:
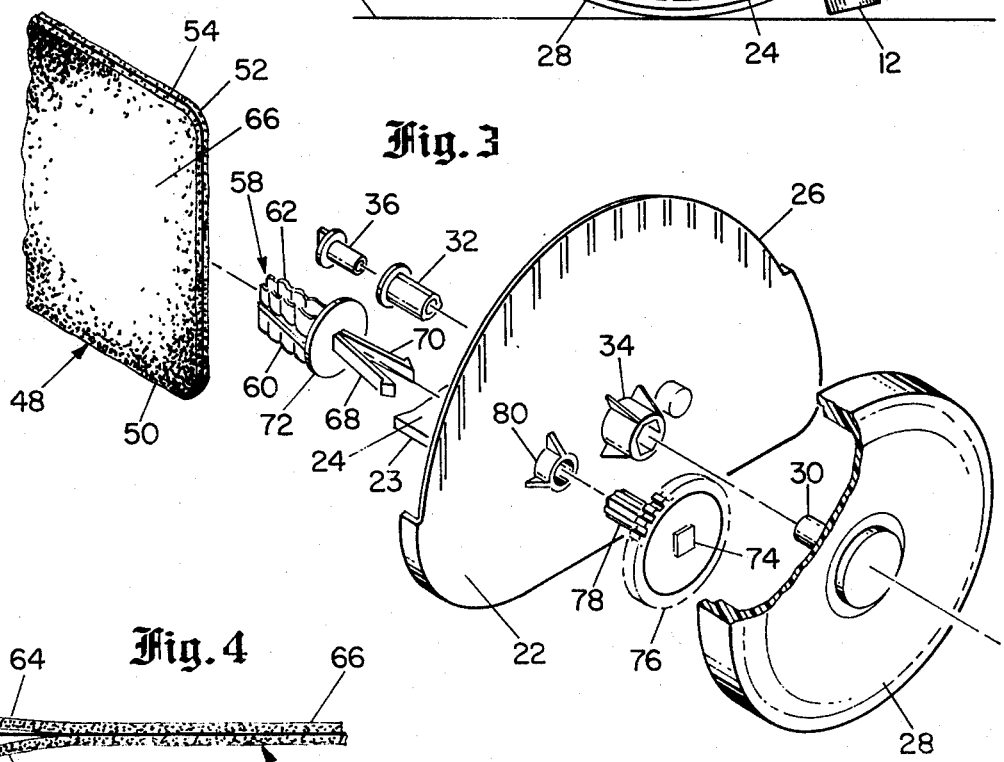
FIG. 3 is an exploded perspective view of one-half of the driving means for the toy of FIG. 1 showing one of the grippers for the impeller.
Figure 4:
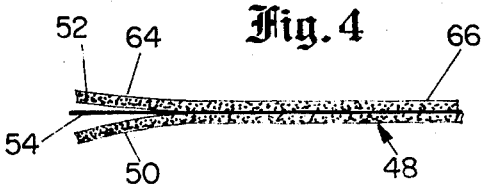
FIG. 4 is a cross-sectional view of the impeller showing its laminated construction.

Impeller assembly 48 is connected to chassis 18 by a pair of attachment members 56, 58 each having a pair of grippers 60, 62 grippingly engaging ends 64, 66 respectively, of impeller assembly 48. Each attachment member 56, 58 also has a pair of resilient fingers 68, 70 formed integrally with a disc portion 72 and releasably engaged in a square opening 74 provided in a pinion 76 and its associated hub 78. Each hub 78 is rotatably mounted in a hollow boss provided on an associated one of the plates 20, 22, like the boss 80 shown in FIG. 3 for plate 22; each pinion 76 extends into driving engagement with a suitable ring gear, like the one shown at 82 for wheel 28. Grippers 60, 62 are an important feature of the invention because they permit impeller 48 to be released before it can be damaged by abnormal use, such as holding one wheel while turning the other wheel.

Impeller assembly 48 may be rapidly rotated in the direction of arrow 84 by grasping handle assembly 38 and pushing toy 10 over surface 14 so that wheel 28 will rotate in the direction of arrow 84 causing pinion gear 76 to be rotated in the direction of arrow 86 by ring gear 82.

Figure 2:
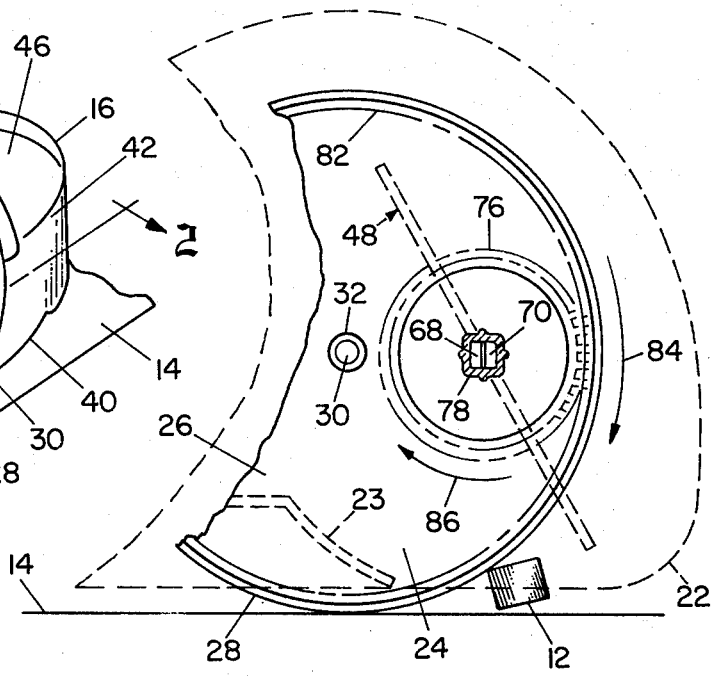
FIG. 2 is an enlarged, partial cross-sectional view taken along line 2—2 of FIG. 1.

Operation of push toy 10 is believed to be apparent and is briefly summarized at this point. A child-user may manipulate handle assembly 38 to guide chassis 18 over surface 14 on its wheels which impart rotation to impeller assembly 48 so that it will flip objects 12 through object inlet 24, up ramp 23, through object outlet 26 and into container 16. It may be noted at this point that the lower edge of plate 22 (FIG. 2) is only slightly above the ground-contacting portion of wheel 28 to facilitate operating toy 10 on shag carpets.

Although the invention has been herein shown and described in what is conceived to be the most practical and preferred embodiment, it is recognized that departures may be made therefrom within the scope of the invention, which is not to be limited to the illustrative details disclosed.

What is claimed is:

1. A push toy adapted to pick up three-dimensional objects lying on a supporting surface, comprising:

I. a housing having an object inlet and an object outlet;

II. a single, rectangular soft, spongy impeller rotatably mounted in said housing across said object inlet;

III. means connected to said impeller for imparting rotation thereto, said means for imparting rotation to said impeller comprising:

A. a pair of wheels rotatably mounted on said housing;

B. a ring gear provided on each wheel;

C. a pinion gear drivingly engaging each of said ring gears; and

D. means for readily detachably gripping said impeller and for connecting each pinion gear to said impeller, said gripping means including a pair of grippers, said grippers gripping said impeller with sufficient force to secure it in place on said toy under normal conditions, but to allow release thereof to reduce damage thereto under abnormal operating conditions; and IV. a container connected to said housing across said object outlet for receiving said objects when they are discharged through said object outlet by said impeller.

2. A push toy as stated in claim 1 wherein said housing includes a plate to which each wheel is rotatably connected in such a manner that the lower edge of each plate is only slightly above said surface.

* * * * *